US008272967B2

(12) United States Patent
Wei et al.

(10) Patent No.: US 8,272,967 B2
(45) Date of Patent: Sep. 25, 2012

(54) STAGE

(75) Inventors: Yuan Yan Wei, Haimen (CN); Clive Coote, Barnet (GB)

(73) Assignee: Vertical Leisure Ltd., Potters Bar (GB)

( * ) Notice: Subject to any disclaimer, the term of this patent is extended or adjusted under 35 U.S.C. 154(b) by 271 days.

(21) Appl. No.: 12/686,930

(22) Filed: Jan. 13, 2010

(65) Prior Publication Data

US 2010/0203976 A1 Aug. 12, 2010

Related U.S. Application Data

(63) Continuation of application No. PCT/GB2008/050588, filed on Jul. 17, 2008.

(30) Foreign Application Priority Data

Jul. 18, 2007 (GB) ..... 0713966.0

(51) Int. Cl.
*A63J 1/00* (2006.01)
*E04H 3/26* (2006.01)

(52) U.S. Cl. ..... 472/75; 472/88; 52/7

(58) Field of Classification Search ..... 472/1, 75, 472/88–90; 52/6–8
See application file for complete search history.

(56) References Cited

U.S. PATENT DOCUMENTS 753,043 A * 2/1904 Cleal ..... 40/415
2,668,331 A * 2/1954 Horn ..... 108/171
3,383,810 A * 5/1968 Mola ..... 52/7
4,580,776 A * 4/1986 Burkinshaw ..... 52/7
4,780,571 A 10/1988 Huang
5,412,890 A 5/1995 Fechter
5,848,501 A * 12/1998 Taipale et al. ..... 52/126.4
2008/0070753 A1 3/2008 Suida et al.

FOREIGN PATENT DOCUMENTS

AU 2005100800 A4 10/2005
WO 00/75461 A1 12/2000
WO 2005/049967 A1 6/2005

OTHER PUBLICATIONS

"Dance Poles | Podiums," Alistage, Aliscaff, http://www.alistage.co.uk/aliscaff_dance_podiums.shtml, pp. 1-3, printed on Jul. 15, 2009.
"Dance Poles | Dance Pole Instructions," http://www.alistage.co.uk/aliscaff_dace_poles_instruc.shtml, p. 9 of 11, printed on Jul. 15, 2009.

* cited by examiner

*Primary Examiner* — Kien Nguyen
(74) *Attorney, Agent, or Firm* — BainwoodHuang

(57) ABSTRACT

A demountable stage includes a substantially cylindrical central hub, which has a vertically extending central axis and is adapted to support a vertically extending pole, a plurality of radially outwardly extending support members mounted to the hub and a stage platform. The stage platform comprises a plurality of segments that are adapted to be supported on the support members.

22 Claims, 6 Drawing Sheets

STAGE

BACKGROUND

This invention relates to a stage. In particular, but not exclusively, it relates to a demountable stage for pole dancing.

Re-locatable pole dance stages have become very popular in recent years. Such stages support a vertically extending dance pole at its lower end. They are popular since they do not require the pole to be fixed at its upper end and so may be used in locations with high or weak ceilings, etc. There are several types of re-locatable pole dance stage available, including solid construction stages, kit stages and modular stages.

Solid construction stages are pre-assembled and are welded or bolted together. They may not generally be disassembled and so are bulky, heavy and difficult to move and/or transport.

Kit stages are supplied in kit form and have to be assembled. Whilst these allow a user to disassemble and re-assemble the stage, the disassembly and re-assembly is time consuming, complex and generally requires multiple tools.

Modular stages are designed to be quickly assembled and disassembled, so that they may be moved and/or transported in a disassembled state. Whilst they are easier to disassemble and re-assemble than kit stages, they are not as sturdy or stable as kit or solid construction stages.

A further limitation of all of the stage types described above is that, to date, they have been provided with stage platforms of single-piece construction. Since the stage platform must be at least a meter square, even disassembled kit and modular stages are bulky and awkward to transport.

SUMMARY

The present invention sets out to provide an improved stage, which may be quickly and easily assembled and disassembled, which is compact, lightweight and easy to transport in a disassembled state, and which is sturdy and stable when assembled.

Accordingly, the present invention provides a demountable pole dancing stage comprising a hub, which is arranged to support a pole, a plurality of support members mounted to the hub and a stage platform, wherein the stage platform comprises a plurality of segments arranged to be supported on the support members.

BRIEF DESCRIPTION OF THE DRAWINGS

An embodiment of the present invention is described below with reference to the accompanying drawings, in which.

DETAILED DESCRIPTION

Figure 1:
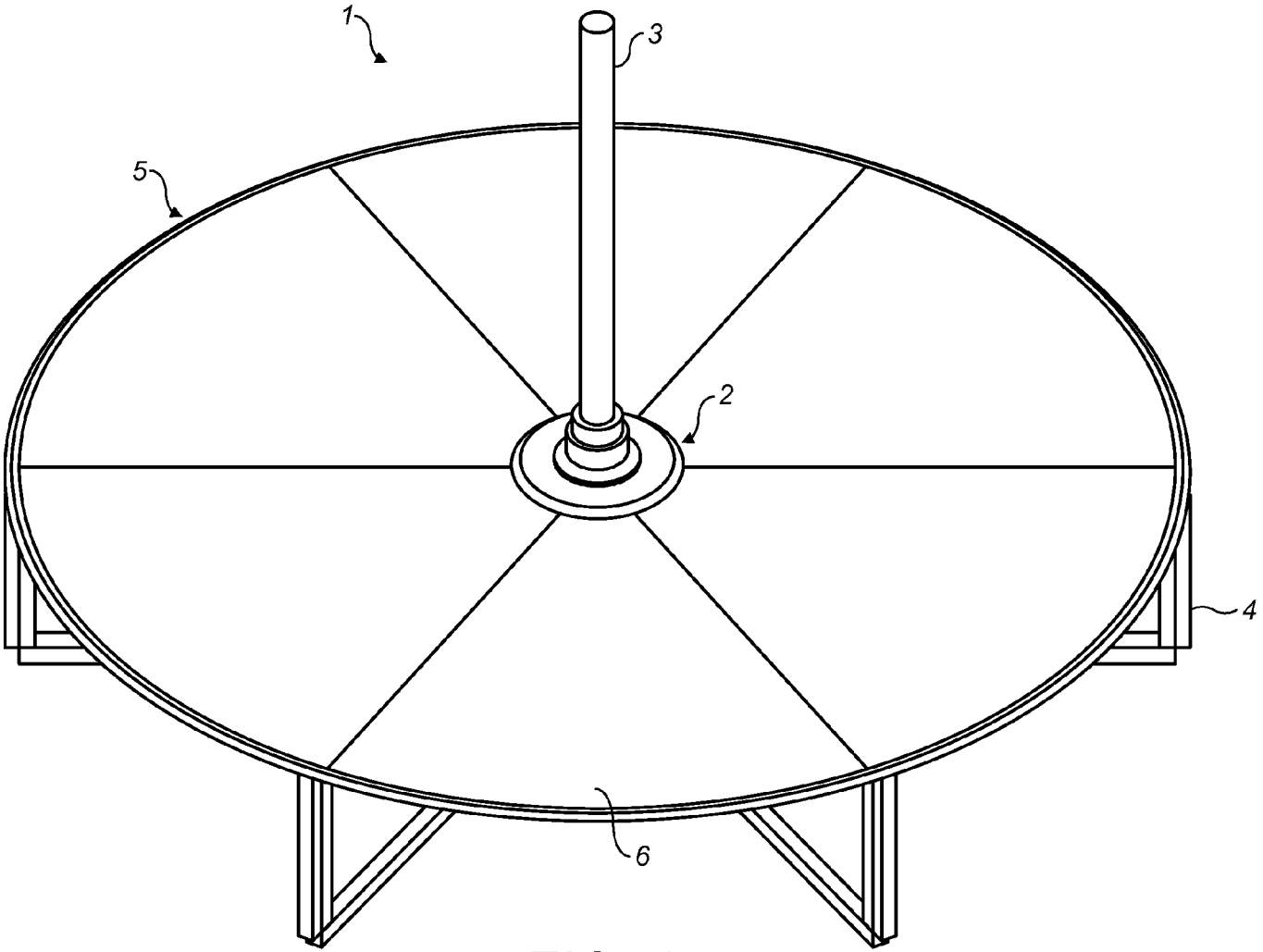
FIG. 1 is a perspective view of the stage in an assembled state.

A stage 1 shown in the drawings comprises a substantially cylindrical central hub 2, which has a vertically extending central axis (axis 1, FIG. 2) and is adapted to support a vertically extending pole 3, six radially outwardly extending support members 4 mounted to the hub 2, and a stage platform 5. The stage platform 5 comprises six separable segments 6, which are supported on the support members 4.

Whilst in the present embodiment six support members 4 and six stage platform segments 6 are provided, the invention is not limited to such a configuration, there may be more or less support members 4 and segments 6 and there need not be an equal number of each.

Each of the support members 4 comprises a generally rectangular frame having an inner upright member 7, an outer upright member 8, and a pair of horizontal connecting members 9, wherein, in use, the lower connecting member 9 bears on the ground and the upper connecting member supports two adjacent segments 6.

Five of the six support members are mounted for rotation about the axis of the hub (axis 1) and about a second vertical axis (axis 2) that is spaced radially outwardly of the central axis (axis 1). The sixth support member is fixedly mounted to the hub 2 so that it cannot rotate.

Each of the rotatable support members 4 is mounted to the hub 2 by an axially spaced pair of collars 11 (shown most clearly in FIGS. 2 and 6), which are mounted for rotation about the axis of the hub (axis 1). The collars 11 are received by the hub 2 to slide against the outer face of the hub 2 and are stacked atop one another. Each collar 11 is provided with a radially extending support arm 12. The distal ends of the support arms of each pair of collars 11 support a respective vertically extending rod 13.

The inner upright member 7 of each rotatable support member 4 is provided with a pair of vertically spaced brackets 20 that are engaged by a respective vertically extending rod 13 so that the upright member 7 can pivot about the vertical axis of the rod 13. Each rod 13 extends between an upper mounting plate 14 and a lower mounting plate 15 that are provided on the hub 2. The mounting plates 14, 15 are annular and are provided with annular grooves 16, 17 in their opposed faces that slidably receive the upper and lower ends of the rod 13 to hold the rod captive.

The fixed support member 4 is also mounted to the hub via two collars 11, which are received by the hub 2 and comprise support arms 12, however, the collars 11 do not slide against the outer face of the hub 2 and the support arms are not pivotally connected to the fixed support member 4. The collars 11 are fixed to the hub and the support arms 12 are fixed to the fixed support member 4, such that no rotation is possible. The collar and support arm may be formed integrally with the fixed support member 4.

Whilst in the present embodiment there is a fixed support member 4 provided, there need not be a fixed support member 4, all of the support members 4 may be rotatable.

Figure 6:
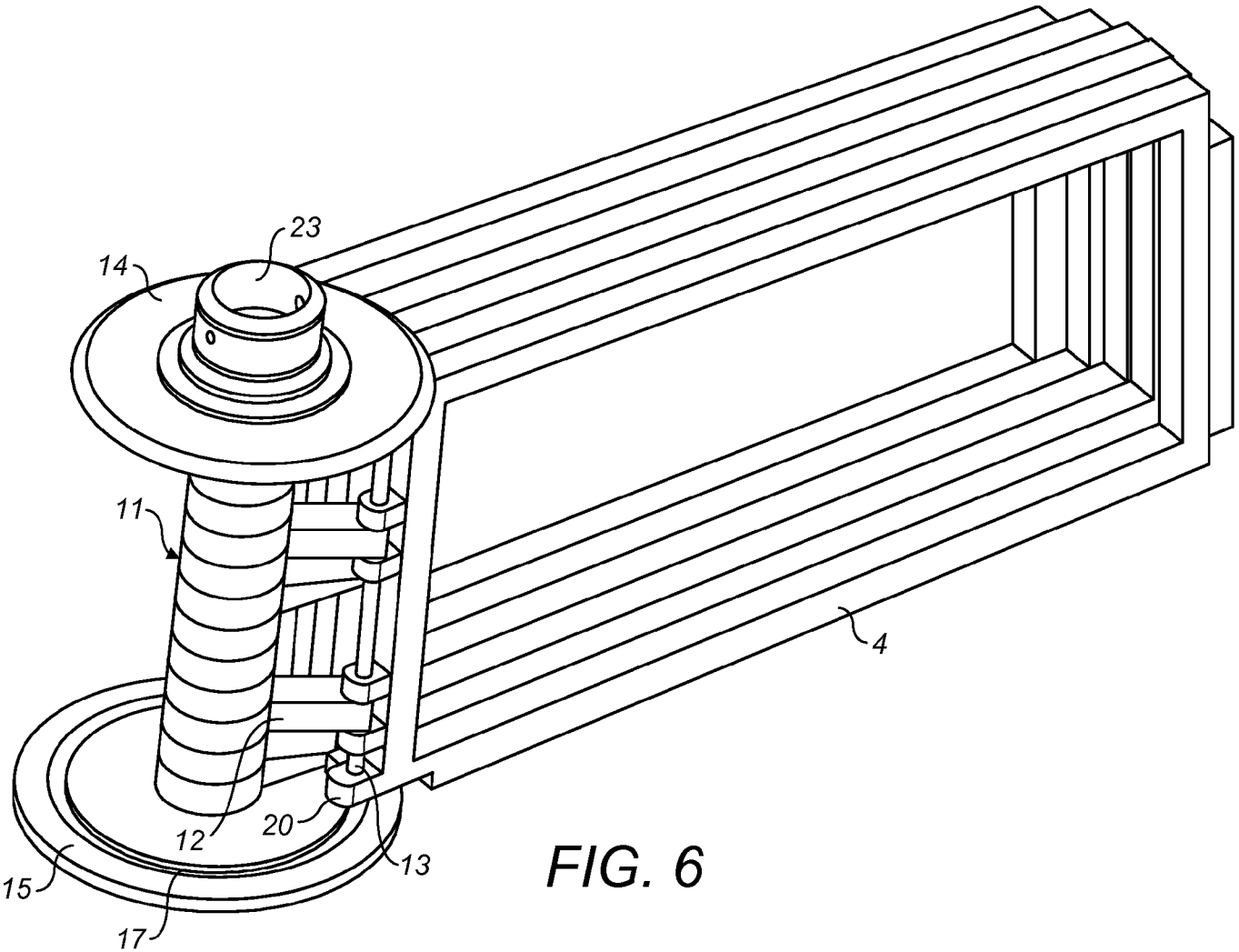
FIG. 6 is a perspective view of the central hub and support members of the stage in a collapsed state.

Since the rotatable support members 4 are mounted to the central hub 2 so that they may be rotated about the vertical central axis (axis 1) and about the second vertical axis (axis 2) it is possible to place the central hub and support members into a collapsed state in which all of the support members 4 lie parallel to each other, extending from the hub in the same radial direction, as shown in FIG. 6. This arrangement is compact and renders the central hub and support members easy to manipulate, transport and store. The support members 4 remain mounted to the hub 2 at all times.

Figure 2:
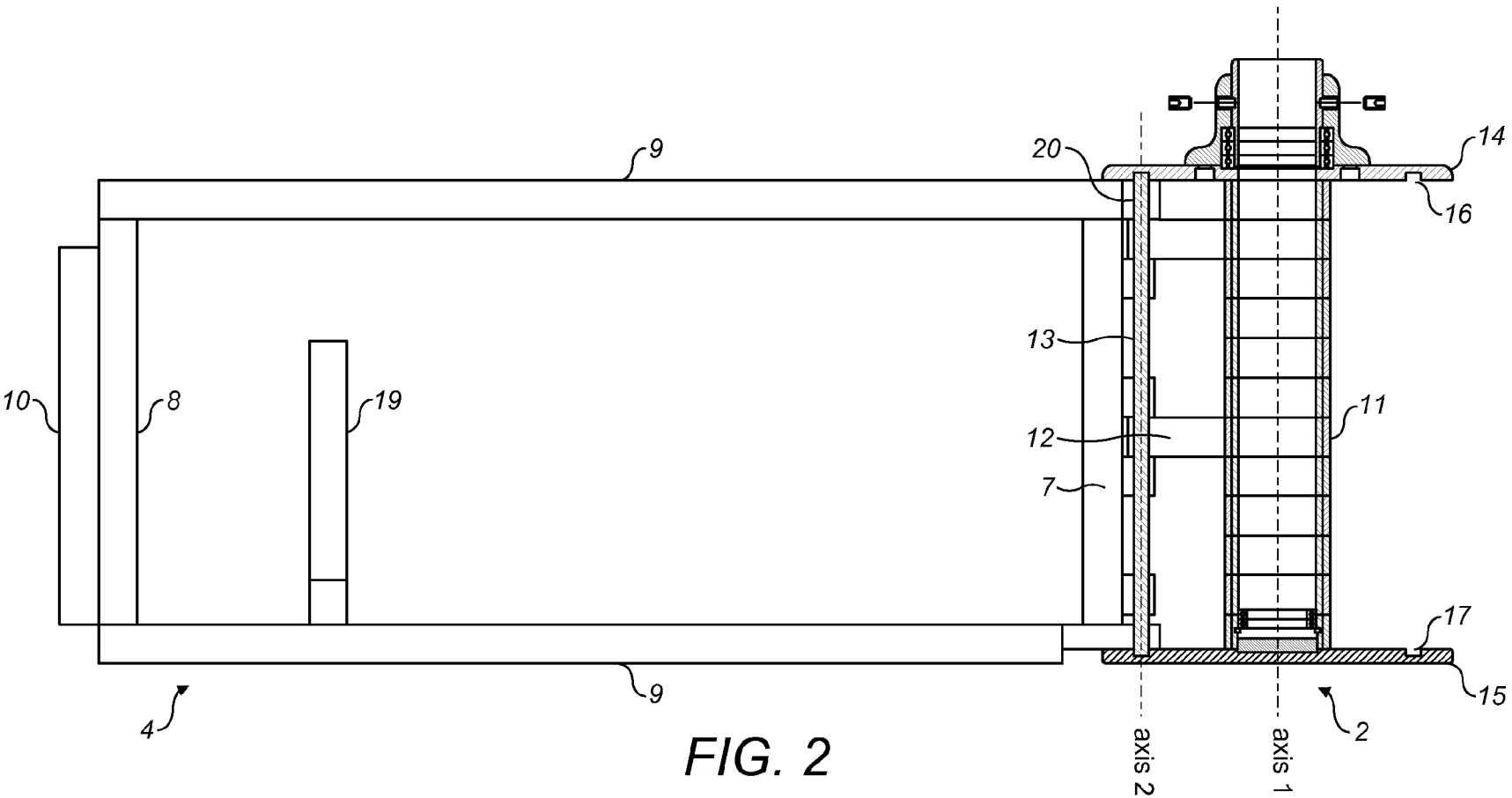
FIG. 2 is a partial sectional view of the stage, showing the central hub and a single rotatable support member.
Figure 3:
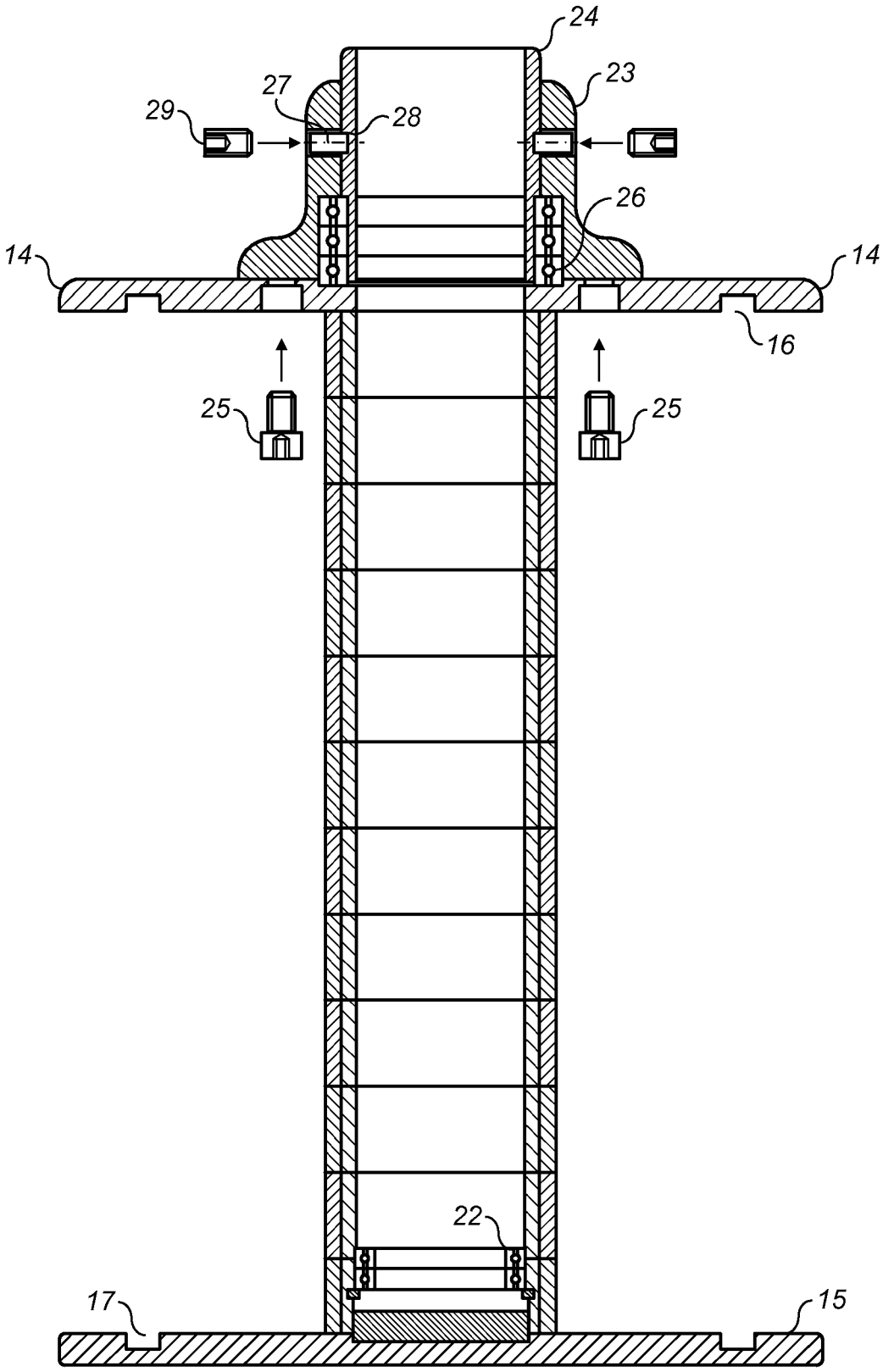
FIG. 3 is a sectional view of the central hub with the pole collar in situ.
Figure 4:
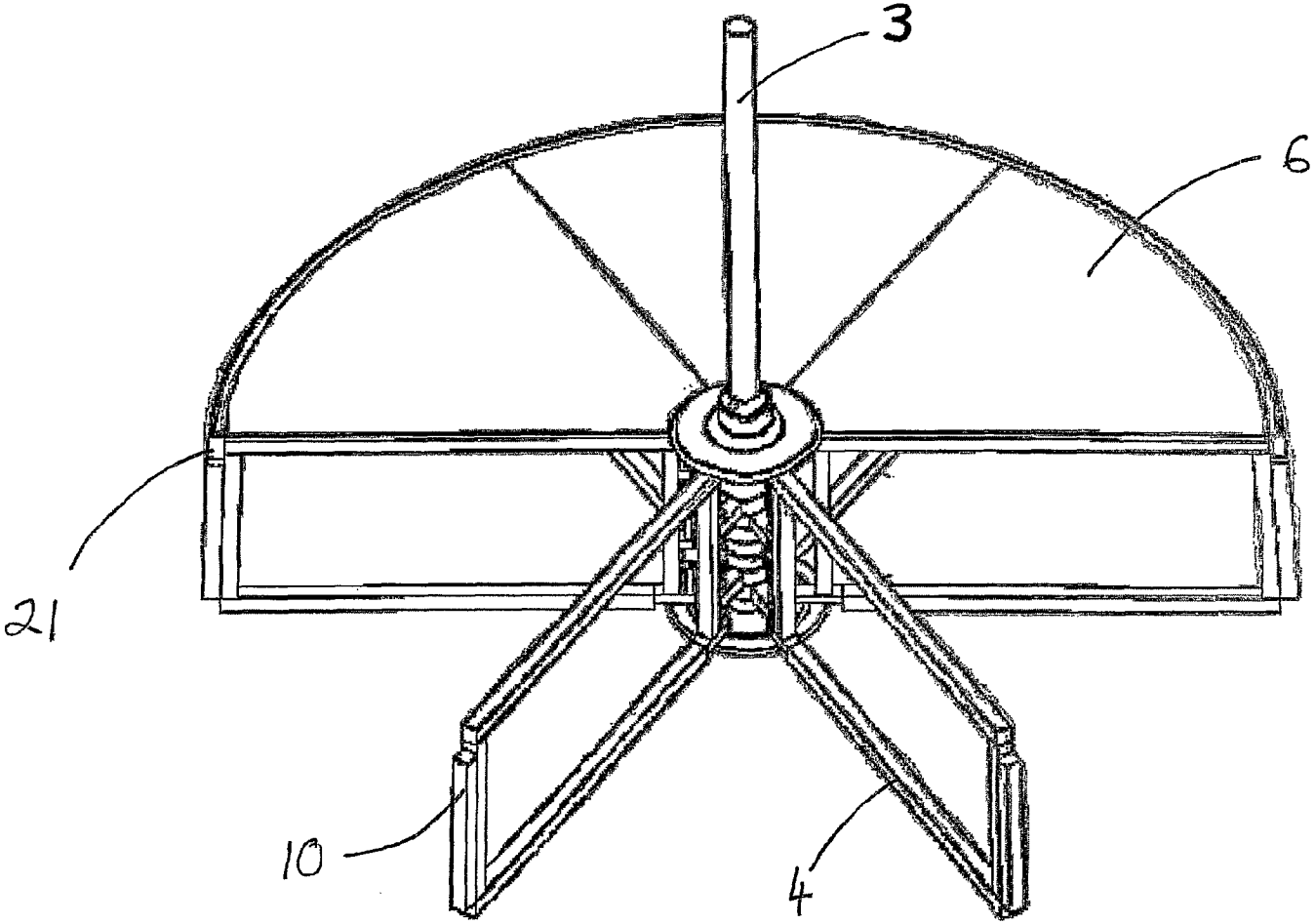
FIG. 4 is a perspective view of the stage in a partially assembled state, with three of the stage platform segments removed.

The central hub 2 comprises a tube that receives the vertically extending pole 3. There are two bearings 22 provided at the bottom of the tube, which rotatably support the bottom of the pole 3, and there is a hub collar 23 mounted to the upper mounting plate 14, which is adapted to receive a pole collar 24 that is provided on the pole 3. The pole collar 24 is shown in FIGS. 2 and 3 without the pole 3. The pole collar 24 is fixed to an outer surface of the pole 3 such that it may not rotate relative to the pole 3. The hub collar 23 is fixed to the upper surface of the upper mounting plate 14 using bolts 25. The hub collar 23 features three bearings 26 that are adapted to receive the pole collar 24 to allow for rotation of the pole 3. The pole 3 may be retained by the central hub 2 so that it is free to rotate about its axis, i.e. the central axis (axis 1), or so that it is fixed and may not rotate. The hub collar 23 is provided with radially extending threaded through holes 27 and the pole collar 24 is provided with a circumferential groove 28 on its outer surface. Threaded elements 29 are provided that are received by the through holes 27 and the groove 28. To retain the pole 3 so that it may rotate, the threaded elements 29 are screwed so that they extend through the through holes 27 and into the groove 28 but do not contact the pole collar 24. To retain the pole so that it may not rotate, the threaded elements are screwed further, to press against the outer surface of the pole collar 24 and thereby grip the pole collar 24 and prevent rotation of the pole 3.

Whilst in the present embodiment the support members 4 are arranged to be mounted to the central hub 2 at all times, they may, if desired, be de-mounted from the central hub 2 by removing the lower mounting plate 15 and removing the collars 11 from the tube by sliding them off the open end of the tube.

The platform segments 6 are planar and substantially wedge-shaped. In use, the segments abut each other to provide a continuous circular stage platform 5. Each segment 6 is supported on a pair of adjacent support members 4. The segments 6 are each provided on their lower surface with two downwardly projecting alignment members 21, one provided in each radially outermost corner. The alignment members 21 are arranged to be received by vertically extending hollow alignment tubes 10 that are provided on the outer upright members 8 of the support members 4. Each alignment tube 10 retains the alignment members 21 of the two adjacent segments 6, which the associated support member 4 supports. The alignment members 21 and alignment tubes 10 prevent relative rotational movement between the support members 4, with each segment 6 preventing relative rotational movement between the two adjacent support members that support it. Each of the segments 6 is further provided with two spring-loaded catches (not shown), one provided adjacent each of the alignment members 21. The catches of each segment 6 are received by holes provided in the upper connecting members of the support members 4 that support the segment 6. The catches lock each segment 6 to the two support members 4 that support it and prevent vertical movement of the segments 6 during use of the stage.

Figure 5:
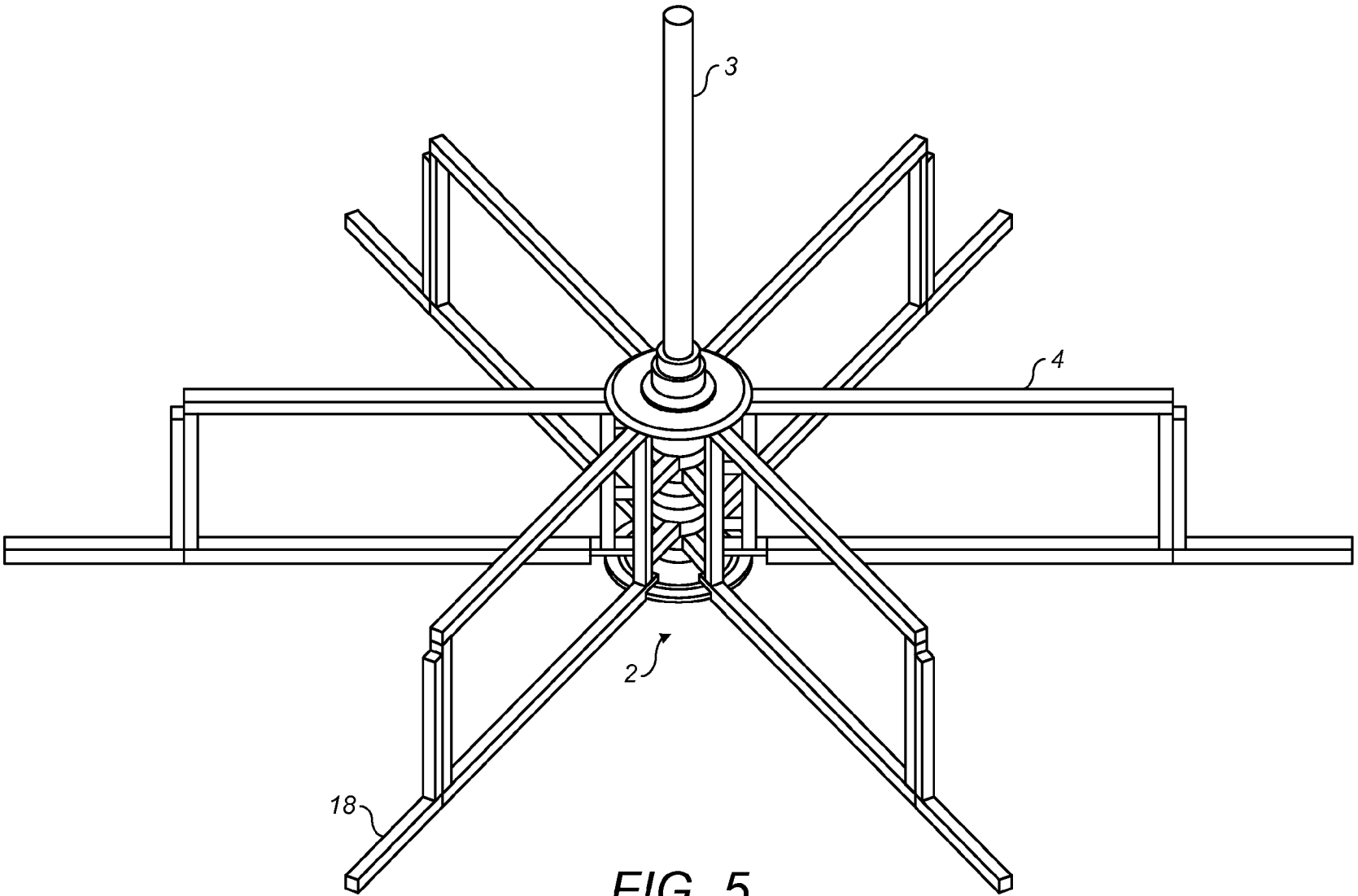
FIG. 5 is a perspective view of the stage in a partially assembled state, with all of the stage platform segments removed and secondary support members extended.

Each of the support members 4 is provided with a radially extendable secondary support member 18 (shown extended in FIG. 5). The secondary support members comprise square tubes that are retained within the lower connecting members 9, which are open at their radially distal ends. The secondary support members are extended by sliding them relative to the lower connecting members 9 through the open ends of the lower connecting members 9 radially beyond the support members 4. The secondary support members 18 provide additional stability to the stage during use.

Each of the support members may additionally be provided with a vertically extending pillar 19, which comprises a bar that is fixed to an upper surface of the lower connecting member 9 and lies below an upper surface of the support member 4, for retaining removable weights, such as dumbbell weights. The addition of such weights provides further stability to the stage during use.

The operation of the stage 1 according to the present embodiment will now be described.

To assemble the stage, from a collapsed state, a user places the central hub 2 and attached support members 4 on the ground with the lower mounting plate 15 against the ground. The support members 4 lie parallel, and in contact with, one another. Next, the user rotates each of the rotatable support members about the central axis (axis 1) to axially space the rotatable support members about the central hub 2. With the rotatable support members 4 axially spaced about the first axis (axis 1) the user may attach the stage segments 6 to form the stage platform 5. Starting from the fixed support member 4, the user locates one of the alignment members 21 of the first segment 6 in the alignment tube 10 of the fixed support member 4 and then manipulates the adjacent rotatable support member 4, by rotation about the central axis (axis 1) and the second axis (axis 2), to locate the second alignment member 21 of the first segment 6 in the alignment tube 10 of the adjacent rotatable support member 4. Next, the catches of the first segment 6 are operated to draw them in for location in the holes in the fixed support member 4 and the adjacent rotatable support member 4, locking the first segment in place and the rotatable support member relative to the fixed support member 4. The remainder of the segments 6 are fixed in place in sequence by repeating the above steps. Finally, the pole is located in the central hub and retained in a rotary or locked state by screwing the screw elements 29.

To disassemble the stage the user firstly releases the catches from one of the segments 6 and removes the segment 6. The remaining segments 6 are removed in sequence in the same manner. Having removed all of the segments the user may rotate each of the rotatable support members 4 about the central axis (axis 1) and about the second axis (axis 2) to bring all of the support members to bear against one another in parallel. The pole 3 may be removed from the central hub 2 before or after removal of the segments 6.

Since the stage platform 5 is segmented and all of the rotatable members 4 may be placed in contact with each other in parallel, the stage, in a disassembled state, is compact and thereby easy to manipulate, store and transport. Furthermore, as is clear from the above description of the operation of the stage, it is quick and easy to assemble and disassemble the stage, as desired.

Whilst in the foregoing embodiment the support members 4 are mounted to the central hub 2 in both the assembled and disassembled state it is envisaged that the support members may alternatively be detachably mounted to the hub. In such an arrangement the central hub 2 may be provided with axially spaced fixings each adapted to detachably receive a radially outwardly extending support member 4. In this arrangement none of the support members need be rotatable. To collapse the stage the support members would be detached from the central hub 2 to be stored separately. Furthermore, equivalents and modifications not described above may also be employed without departing from the scope of the invention, which is defined in the accompanying claims.

What is claimed is:

1. A demountable pole dancing stage comprising a hub, which is arranged to support a pole; a plurality of support members mounted to the hub; and a stage platform, wherein the stage platform comprises a plurality of segments arranged to be supported on the support members, wherein at least some of the support members are mounted for rotation about a central axis of the hub and about a second axis that is spaced radially outwardly of the central axis, and wherein each rotatable support member is mounted to the hub via at least one collar which is mounted for rotation about the central axis of the hub and has a radially extending support arm; and wherein each rotatable support member is pivotally mounted to the support arm.

2. A demountable pole dancing stage as claimed in claim 1, wherein each of the support members comprises a generally rectangular frame having an inner member and an outer member and a pair of connecting members connecting the inner and outer members, one of the connecting members being arranged for bearing on the ground.

3. A demountable pole dancing stage as claimed in claim 1, wherein each rotatable support member is mounted to the hub via a pair of collars and support arms, with the inner member of the support member pivotally mounted on the support arms of the collars via a rod.

4. A demountable pole dancing stage as claimed in claim 3, wherein the hub further comprises first and second mounting plates which are provided with annular grooves in their opposed faces that slidably receive, respectively, first and second ends of each of the rods.

5. A demountable pole dancing stage as claimed in claim 1, wherein, in use, each platform segment lies between and is supported on a pair of adjacent support members.

6. A demountable pole dancing stage as claimed in claim 5, wherein each platform segment is arranged to prevent relative rotational movement between the pair of adjacent support members that support it.

7. A demountable pole dancing stage as claimed in claim 1, wherein one of the support members is fixed to the hub, such that it may not rotate.

8. A demountable pole dancing stage as claimed in claim 1, wherein at least one of the support members is provided with a radially extendable secondary support member, which can extend radially beyond the support member for bearing on the ground.

9. A demountable pole dancing stage as claimed in claim 1, wherein at least one of the support members is provided with a bar, which is arranged to retain weights.

10. A demountable pole dancing stage as claimed in claim 9, wherein the bar is vertically extending and is located below an upper surface of the support member.

11. A demountable pole dancing stage as claimed in claim 1, wherein the stage platform is circular.

12. A demountable pole dancing stage as claimed in claim 1, wherein the hub is a substantially cylindrical central hub comprising a vertically extending central axis and is arranged to support a vertically extending pole, and/or the plurality of support members are radially outwardly extending support members.

13. A demountable pole dancing stage according to claim 1, wherein the hub is arranged to support a pole with a person supported thereon.

14. A demountable pole dancing stage according to claim 1, wherein the hub is arranged to support a pole by the hub receiving an end of the pole.

15. A demountable pole dancing stage according to claim 14, wherein the hub comprises a recess and is arranged to support a pole by receiving an end of a pole in the recess.

16. A demountable pole dancing stage according to claim 1, wherein the hub is arranged to support a pole by locating an end of the pole within the hub.

17. A demountable pole dancing stage according to claim 1, wherein the hub comprises a bearing for rotatably supporting a pole.

18. A demountable pole dancing stage according to claim 1, comprising a hub collar comprising a bearing for receiving part of a pole.

19. A demountable pole dancing stage comprising a hub, which is arranged to support a pole; a plurality of support members mounted to the hub;

and a stage platform, wherein the stage platform comprises a plurality of segments arranged to be supported on the support members, wherein each of the support members comprises a generally rectangular frame having an inner member and an outer member and a pair of connecting members connecting the inner and outer members, one of the connecting members being arranged for bearing on the ground.

20. A demountable pole dancing stage comprising a hub, which is arranged to support a pole; a plurality of support members mounted to the hub;

and a stage platform, wherein the stage platform comprises a plurality of segments arranged to be supported on the support members, wherein at least some of the support members are mounted for rotation about a central axis of the hub and about a second axis that is spaced radially outwardly of the central axis, and wherein each rotatable support member is mounted to the hub via a pair of collars and support arms, with the inner member of the support member pivotally mounted on the support arms of the collars via a rod.

21. A demountable pole dancing stage as claimed in claim 20, wherein the hub further comprises first and second mounting plates which are provided with annular grooves in their opposed faces that slidably receive, respectively, first and second ends of each of the rods.

22. A demountable pole dancing stage comprising a hub, which is arranged to support a pole; a plurality of support members mounted to the hub;

and a stage platform, wherein the stage platform comprises a plurality of segments arranged to be supported on the support members, wherein at least one of the support members is provided with a radially extendable secondary support member, which can extend radially beyond the support member for bearing on the ground.

* * * * *